United States Patent [19]

Kunz

[11] Patent Number: 4,967,514

[45] Date of Patent: Nov. 6, 1990

[54] TUMBLING APPARATUS WITH DOUBLE ROTATION

[75] Inventor: Pierre Kunz, Montmorency, France

[73] Assignee: Metallgesellschaft Aktiengesellschaft, Frankfurt am Main, Fed. Rep. of Germany

[21] Appl. No.: 377,931

[22] Filed: Jul. 7, 1989

[30] Foreign Application Priority Data

Jul. 8, 1988 [DE] Fed. Rep. of Germany ..... 3823241

[51] Int. Cl.[5] ..... B24B 31/00; B24B 31/02

[52] U.S. Cl. ..... 51/163.1; 51/164.1; 51/164.2; 51/313

[58] Field of Search ..... 51/313, 163.1, 163.2, 51/164.1, 164.2; 366/219, 220

[56] References Cited

U.S. PATENT DOCUMENTS

| | | | |
|---|---|---|---|
| 2,359,322 | 10/1944 | Lupo | 51/164.1 |
| 3,078,623 | 2/1963 | Stanley | 51/313 X |
| 3,579,920 | 5/1971 | Heiberger | 51/164.2 |

FOREIGN PATENT DOCUMENTS

| | | | |
|---|---|---|---|
| 1767318 | 9/1971 | Fed. Rep. of Germany . | |
| 5919667 | 2/1984 | Japan | 51/313 |

*Primary Examiner*—Frederick R. Schmidt
*Assistant Examiner*—Bruce P. Watson
*Attorney, Agent, or Firm*—Herbert Dubno

[57] ABSTRACT

Tumbling of workpieces is improved by providing a double rotation about two axes which do not intersect but rather lie in mutually parallel spaced apart planes.

8 Claims, 2 Drawing Sheets

1
2
3
4
5
6
7
8
A
11
12

TUMBLING APPARATUS WITH DOUBLE ROTATION

FIELD OF THE INVENTION

My present invention relates to a tumbling apparatus and, more particularly, to a tumbling apparatus in which workpieces are tumbled in a drum by rotation of the drum about an axis and by rotation of the drum and its axis about a second axis.

BACKGROUND OF THE INVENTION

Tumbling is a surface finishing operation in which workpieces are caused to move in a bed of treating elements, e.g. abrasive particles, or against one another in such manner that the relative motion between the workpieces and the treating elements causes an alteration of the surface, e.g. a polishing, deburring or material removal.

It has been proposed heretofore to improve upon the tumbling action of a simple rotation of the drum by providing a double rotation or two-axis tumbling action.

Such a system is described in German Patent Document No. 1,767,318. In that system a working container which can be closed and can receive the workpieces and treating elements, is rotatable about a first axis, the container being journaled for such rotation on a movable frame. The movable frame, in turn, can be rotated about a second axis which is coplanar with the first, relative to a main frame or support. Drive means are provided for rotating the drum about the two axes.

The two axes extend through the container and intersect within the container.

The drive means can be effective to hold the contents of the container against the container walls by centrifugal force, but because centrifugal forces about two axes are superimposed, relative motion between the two workpieces and the treating elements is reinforced by comparison with the action obtained when only single axis rotation was provided.

This apparatus, therefore, can allow higher angular velocities to be used and generally has been believed to bring about a more effective surface treatment than single axis tumbling.

German Patent Document No. 1,767,318, however, does not provide verifiable results along these lines, but is evidence of the fact that improvements in tumbling operations have been required in the past. Indeed, I have found that tumbling processes require further improvement and are not fully satisfactory even when carried out with rotation about two coplanar axes.

OBJECTS OF THE INVENTION

It is, therefore, the principal object of the present invention to provide an improved apparatus for carrying out tumbling and which can generate a far more effective surface treatment of workpieces than earlier apparatuses for this purpose.

Still another object of this invention is to provide an improved method of operating such an apparatus or surface treatment method in which a more effective tumbling can result.

It is also an object of the invention to provide an improved tumbling apparatus which permits a given degree of surface treatment to be obtained in a shorter time and at lower cost than has hitherto been the case.

SUMMARY OF THE INVENTION

I have found, surprisingly, that these objects can be obtained in accordance with the invention when the first and second axes are spaced apart in different parallel planes by a distance A which is at least 50 mm and preferably about one quarter of the distance between opposite peripheral walls of the container.

With any spacing A between the planes, I have observed an improved tumbling result in the sense of the invention but with the preferred spacings, material can be removed at a much higher rate, all other parameters being the same, than with two-axis tumbling in which the two axes lie in the same plane and intersect one another.

According to a feature of the invention, the two axes which lie in planes spaced apart by the distance A can extend at angles of 40° to 90° to one another.

According to another feature of the invention, separate drives are provided for rotating the container about a first axis and the frame in which the container is journaled about the second axis independently from one another, i.e. the drives are independently controllable and can rotate the container and frame at different speeds.

According to a further feature of the invention, the working container has two planar end walls lying at right angles to the first axis and connected by planar peripheral walls so that the container is of polyhedral cross section. Two square end walls may be connected by four peripheral walls or two octagonal end walls according to the invention can be connected by eight peripheral walls. One of the peripheral walls can have the closable opening through which the container is charged or discharged.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figures 1, 2:
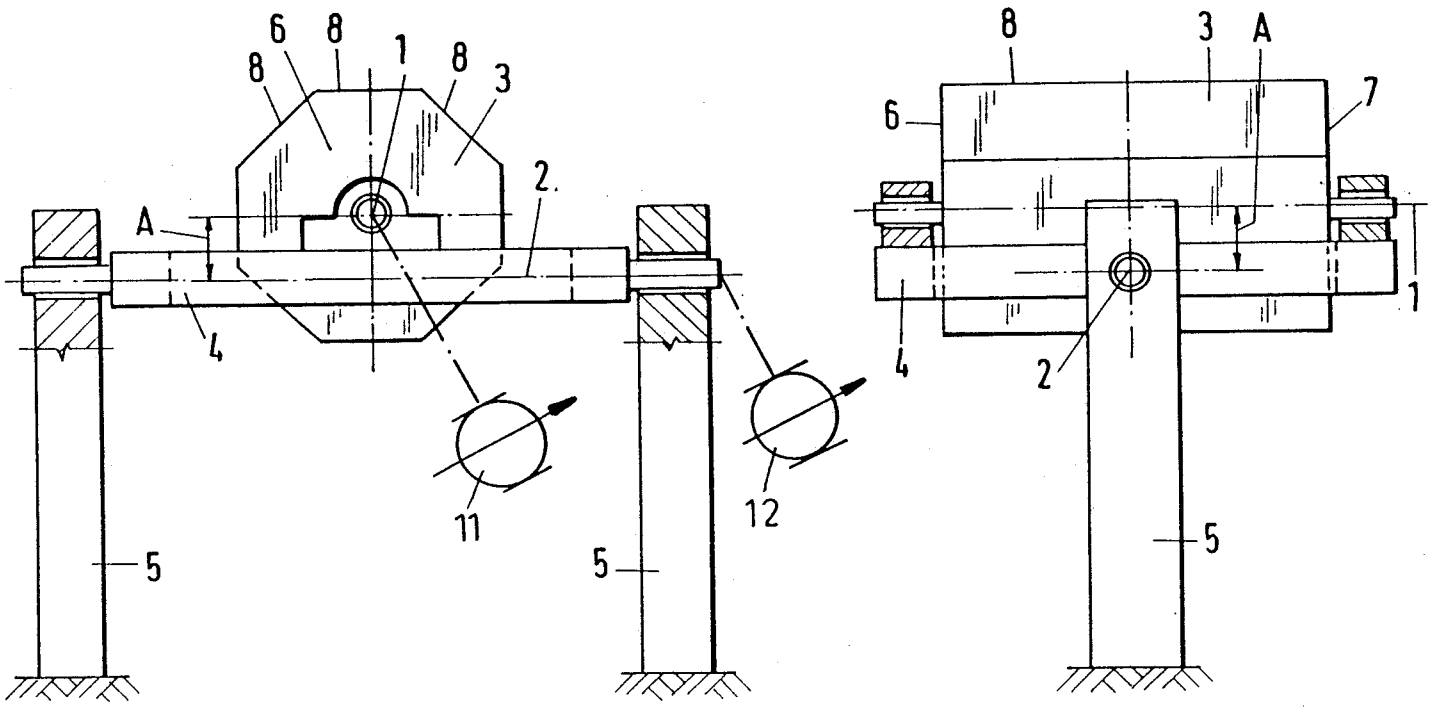
FIG. 1 is a highly diagrammatic side elevational view, partly broken away, illustrating the journal of the container on a movable frame in a support diagrammatically shown to be constituted by a pair of posts.
FIG. 2 is a front elevational view, partly broken away of the apparatus of the FIG. 1.
Figure 3:
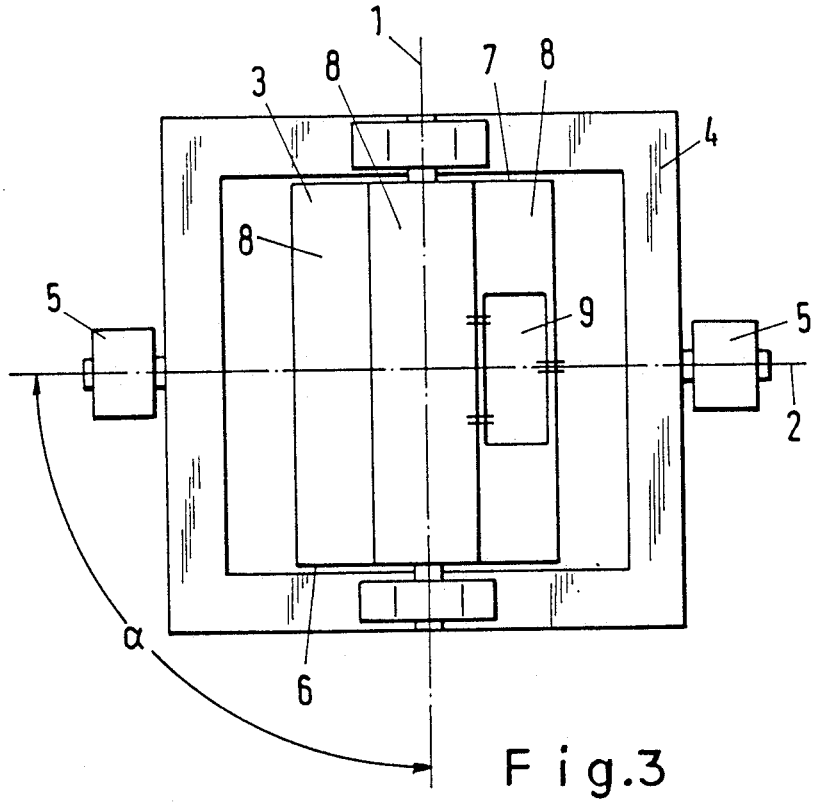
FIG. 3 is top plan view of this apparatus.

From FIGS. 1–3 it can be seen that the two-axis or double-rotation tumbling apparatus comprises an elongated working container 3 which is rotatably mounted in a movable frame 4 for rotation about an axis 1 referred to herein as the first axis.

The movable frame 4 is, in turn, mounted for rotation about a second axis 2 in a main frame or support 5.

From FIGS. 1 and 2, moreover, it will be apparent that the container 3 is provided with octagonal end walls 6 and 7 bridged by eight peripheral walls 8.

According to the invention, the axes 1 and 2 lie in respective but mutually parallel planes which are spaced apart by the aforementioned distance A.

In the embodiment shown, the angle $\alpha$ between the two axes (see FIG. 3) is 90°.

One of the walls 8 has a charging opening 9 which can be locked closed in any conventional manner and enables the workpieces to be introduced alone or together with treating elements for tumbling in the container.

Separate drives 11 and 12 are provided for rotating the container 3 about the axis 1 and the frame 4 about the axis 2, respectively, and are individually controllable to apply different speeds.

The effect of the distance A is readily appreciated from the following specific example.

The influence of the distance A between the axes on the effectiveness of the tumbling was determined by experiments. Iron angles having dimensions of 30 mm×30 mm×3 mm and having a weight of 110 g were tumbled for 30 minutes in a mixture of abrasive elements, water and grinding aids. The weight loss was subsequently determined. The container was uniformly rotated at a speed of 135 r.p.m., which corresponded to a centrifugal acceleration of 1 g. The speed of the movable frame was varied in steps between 80 and 237 r.p.m. so that the centrifugal acceleration was varied between 1 g and 9 g. The distances A between the planes which contained the axes 1 and 2 were 0, 20, 50, 80 and 100 mm. Under these conditions the weight losses stated in Table 1, in grams per kilogram, were measured. It is apparent that with a distance 0 between said planes the influence of the speed of the movable frame in the range from 1 to 9 g resulted in an increase of the abrasive wear from 0.12 to 0.22 grams per kilogram (first result column of Table 1). The weight loss cannot be increased by a change of distance between said planes if the centrifugal acceleration that is due to the motions of the container and the movable frame is consistent at 1 g (first result line of Table 1).

But significantly higher weight losses can be achieved if the two measures stated above are combined. Under the selected boundary conditions, results which were up to 19 times better than the basic value (2.32 to 0.12=19.33) were achieved.

It is pointed out that the distance between the planes and the speed of the frame must not be indiscriminately increased. But the test results indicate that much larger increases of performance can be achieved by the tumbling apparatus in accordance with the invention than in conventional plants which have separate drives for the working container and the movable frame but in which there is a zero distance A between the planes which contain the axes of rotation.

TABLE I

| Speed of frame r.p.m. | g | Distance A between planes containing the axes of rotation in mm 0 | 20 | 50 | 80 | 110 |
|---|---|---|---|---|---|---|
| 80 | 1 | 0.12 | 0.12 | 0.11 | 0.09 | 0.13 |
| 135 | 3 | 0.12 | 0.15 | 0.16 | 0.31 | 0.74 |
| 177 | 5 | 0.14 | 0.16 | 0.18 | 0.78 | 1.21 |
| 207 | 7 | 0.17 | 0.22 | 0.29 | 1.33 | 1.80 |

TABLE I-continued

| Speed of frame r.p.m. | g | Distance A between planes containing the axes of rotation in mm 0 | 20 | 50 | 80 | 110 |
|---|---|---|---|---|---|---|
| 237 | 9 | 0.22 | 0.35 | 0.54 | 1.99 | 2.32 |

Figure 4:
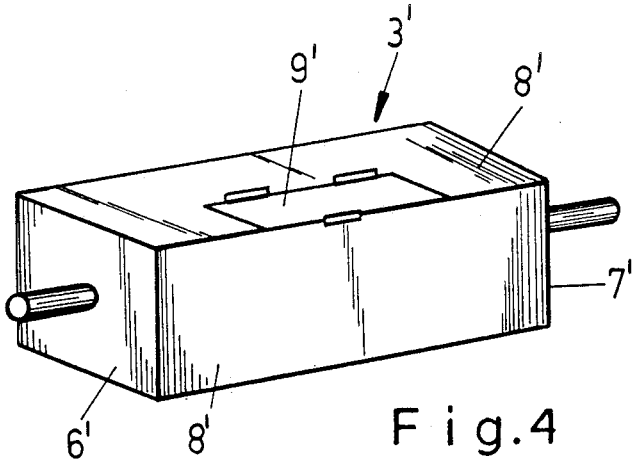
FIG. 4 is a perspective view of a container which can be substituted for the container of FIGS. 1–3 in the apparatus thereof.

In FIG. 4, I have shown a container 3' which can be substituted for the container 3 in the apparatus of FIGS. 1–3 with similar effect. Here the container has square end walls 6' and 7' and only four peripheral walls 8', one of which is provided with the door 9' which can be closed.

I claim:

1. An apparatus for tumbling workpieces, comprising:

a support;

a movable frame journaled on said support for rotation about a first axis; and a single container for receiving said workpieces journaled on said frame for rotation about a second axis, said axes lying in mutually parallel planes spaced apart by a distance A from one another where A is at least 50 mm and both of said axes traversing through said container, said axes lying at an angle of 40° to 90° to one another.

2. The apparatus defined in claim 1, further comprising mutually independent drives operatively connected with said container and with said frame for rotating same about the respective axes.

3. The apparatus defined in claim 1 wherein said container is of polygonal cross section.

4. The apparatus defined in claim 3 wherein said container is formed with two planar end walls lying at right angles to the axis about which said container is journaled for rotation on said frame, and planar peripheral walls connecting said end walls and extending parallel to the axis about which said container is journaled on said frame.

5. The apparatus defined in claim 4 wherein said end walls are square and four of said peripheral walls form said container with said end walls.

6. The apparatus defined in claim 4 wherein said end walls are octagonal and eight of said peripheral walls connect said end walls.

7. The apparatus defined in claim 4 wherein one of said peripheral wall is connected by an opening allowing charging and discharging of said container.

8. A method of tumbling workpieces which comprises the steps of:

(a) introducing said workpieces into a single polygonal container;

(b) rotating said container a plurality of full revolutions about a first axis; and (c) simultaneously rotating said container a plurality of full revolutions about a second axis lying in a plane parallel to a plane of said first axis but spaced by a distance A of at least 50 mm therefrom, said second axis including an angle of 40° to 90° to said first axis, said distance A being about one quarter of a distance between opposite peripheral walls of the containers and both of said axes traversing through said container.

* * * * *